US007279651B1

(12) United States Patent
Nguyen

(10) Patent No.: US 7,279,651 B1
(45) Date of Patent: Oct. 9, 2007

(54) AUTOMATIC SHUT-OFF SWITCH FOR MAIN POWER SOURCE

(76) Inventor: Bill Nguyen, 16536 Avalon Blvd., Carson, CA (US) 90746

( * ) Notice: Subject to any disclaimer, the term of this patent is extended or adjusted under 35 U.S.C. 154(b) by 197 days.

(21) Appl. No.: 11/126,311

(22) Filed: May 11, 2005

Related U.S. Application Data

(60) Provisional application No. 60/584,448, filed on Jul. 1, 2004.

(51) Int. Cl.
*H01H 3/20* (2006.01)

(52) U.S. Cl. ..... 200/330; 335/172

(58) Field of Classification Search ..... None
See application file for complete search history.

(56) References Cited

U.S. PATENT DOCUMENTS 4,019,166 A * 4/1977 Lawrence et al. ..... 335/172
4,390,922 A * 6/1983 Pelliccia ..... 361/170
4,414,994 A * 11/1983 Hogan ..... 137/38
4,833,461 A * 5/1989 Yeager ..... 340/690
4,841,287 A * 6/1989 Flig et al. ..... 340/690
5,196,658 A * 3/1993 Gula ..... 200/50.32
5,306,957 A * 4/1994 Ellingham et al. ..... 307/141
5,436,416 A * 7/1995 Fletcher ..... 200/61.45 R
5,475,190 A * 12/1995 Smith et al. ..... 200/50.01
5,695,046 A * 12/1997 Turner et al. ..... 200/330
5,902,973 A * 5/1999 Ramey et al. ..... 200/50.01
5,905,239 A * 5/1999 Turner et al. ..... 200/330
5,911,316 A * 6/1999 Chu ..... 200/331
6,072,132 A * 6/2000 Turner ..... 200/330
6,441,329 B2 * 8/2002 Guille et al. ..... 200/400
6,489,577 B2 * 12/2002 Kurata ..... 200/331
6,552,286 B2 * 4/2003 Yang et al. ..... 200/330
2002/0104747 A1 * 8/2002 Turner et al. ..... 200/330

FOREIGN PATENT DOCUMENTS

JP 09180619 A * 7/1997
JP 11288655 A * 10/1999

* cited by examiner

*Primary Examiner*—Ramon M. Barrera
(74) *Attorney, Agent, or Firm*—Seldon & Scillieri

(57) ABSTRACT

An automatic turn-off switch responsive to displacement of a movable element placed on a seat which resides on the top of a chute located with an opening at the bottom immediately adjacent to a pivotal lever. A spring-loaded latch is normally biased in a contracted condition. An automatic release is cooperatively carried between the spring latch and the lever whereby displacement of the mechanical movable element causes the release to disconnect from the contracted latch, whereby the latch is released for forcible engagement with a conventional on/off switch in a circuit breaker box. When the circuit breaker switch is in the "on" position, the released latch engages the switch and causes the switch to move to its "off" position, terminating all electrical communication with the main power source.

14 Claims, 2 Drawing Sheets

AUTOMATIC SHUT-OFF SWITCH FOR MAIN POWER SOURCE

This application claims the benefit under 35 U.S.C. 119(e) of co-pending U.S. Provisional Patent Application 60/584,448 filed Jul. 1, 2004.

BACKGROUND OF THE INVENTION

1. Field of the Invention

The present invention relates to the field of protective switches for power sources, and more particularly to a novel automatic shut-off switch which is responsive to either motion displacement of a mechanical element, such as a ball, and/or which is responsive to displacement of the mechanical element to activate an on/off switch to its off position in order to cut-off and shut down a main power source.

2. Brief Description of the Prior Art

In the past, it has been the conventional practice to employ a circuit breaker arrangement which acts as a terminal for a plurality of household or dwelling circuits. Generally a plurality of individual and separate circuit breakers are incorporated into a circuit box and all of the circuits are connected in common to a single on/off switch. Normally, when one of the circuits is overloaded, the individual circuit breaker for that circuit will automatically open to disconnect the electric current supplied from the main power source. However, problems and difficulties have been encountered which stem largely from the fact that all of the circuit breakers are independent of one another and only the main power switch is common. This power switch is overload operated and does not have any automatic shut-off capability responsive to vibration or natural disturbances.

Conventional main circuit breaker installations having a common on/off switch are for overload protection as described above. However, such circuit breaker shut-off switches are individually or manually operated and do not respond to vibration or violent shaking conditions, such as encountered during an earthquake, or to a shaking movement. The master circuit breaker switch will not automatically shut-off in response to shaking or physical displacement of the circuit box or dwelling in which it is installed. During a violent earthquake, the master switch and all the individual circuit switches will remain "on" so that any falling debris or the like that falls may sever "hot" wires which will cause excessive sparking resulting in fire.

Therefore, a long-standing need has existed to provide an automatic shut-off switch arrangement which can be used in combination with the main on/off switch in a circuit breaker network and wherein such an automatic switch is responsive to a mechanical displacement of an element, such as a ball or the like. Displacement of the ball may be in response to the resultant movement from an ongoing earthquake and the main automatic shut-off switch arrangement may be mechanically actuated or electrically actuated.

SUMMARY OF THE INVENTION

In view of the foregoing, the problems and difficulties enumerated are avoided by the present invention which provides a novel automatic turn-off switch which is responsive to displacement or movement of a mechanical element, such as a ball or the like. The automatic switch includes a seat for the movable element which resides in the top of a chute located with an opening at the bottom immediately adjacent to a pivotal lever. The device further includes a spring-loaded latch which is normally biased in a contracted condition. An automatic release is cooperatively carried between the spring latch and the lever whereby displacement of the mechanical element or ball causes the release to disconnect from the compressed or contracted latch, whereby the latch is released for forcible engagement with a conventional on/off switch in a circuit breaker box. When the circuit breaker switch is in the "on" position, the released latch engages the switch and causes the switch to move to its "off" position, terminating all electrical communication with the main power source.

Therefore, it is among the primary objects of the present invention to provide a novel automatic switch for disconnecting all of the circuit breakers in a circuit breaker box from the main power source in response to shaking or movement of a mechanical element.

Another object of the present invention is to provide a novel automatic turn-off switch for a circuit breaker box which is responsive to deployment of a mechanical element when deployed in response to a shaking or vibratory movement, such as during an earthquake.

Yet another object of the present invention resides in providing a mechanical and/or an electrical shut-off switch for a main circuit breaker box that operates the conventional on/off switch on the box in response to moving action of a mechanical part.

Still a further object resides in providing a solenoid-operated switch that is activated by mechanical movement such as during an earthquake or other environmental condition.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figure 1:
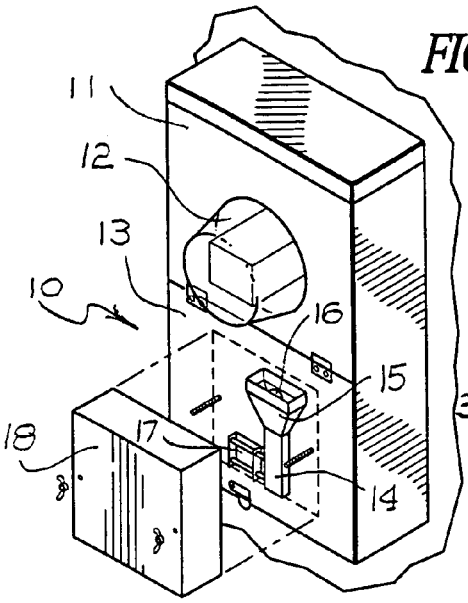
FIG. 1 is a reduced perspective view illustrating the novel automatic shut-off switch incorporating the present invention.

Referring to FIG. 1, the novel automatic shut-off switch incorporating the present invention is illustrated in the general direction of arrow 10 and is installed on a conventional circuit breaker box 11 having a meter 12. The box contains a standard array of individual circuit breaker switches that are connected between a variety of internal household or building structure circuits and a main power source. Also, the standard array includes a conventional master switch for turning the main power source on and off. Immediately below the meter 12, a hinged panel 13 is provided which is detachably connected to the box. Mounted on the front face of the panel 13 is the automatic shut-off switch mechanism 10 which includes a chute 14 having an enlarged input funnel 15 that encloses a balanced mechanical element, such as an actuator ball 16. The ball is and operates as an actuator for releasing a spring loaded carriage 17. Release of the carriage 17 in response to deployment of the actuator ball 16 causes the released carriage to advance toward the chute 14 and in so doing forcibly engages with and throws the master switch 26, shown in FIGS. 2 and 3, which shuts off the complete electrical power source to the array of circuit breaker switches in the breaker box 11. A cover 18 serves to enclose the shut-off switch mechanism.

Figure 3:
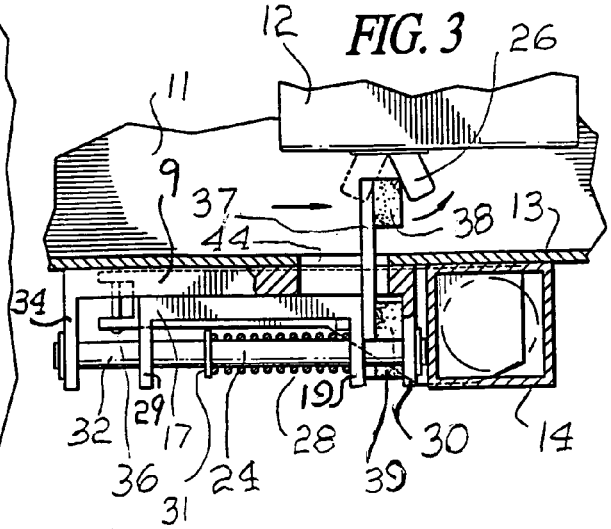
FIG. 3 is a transverse, cross-sectional view of the shut-off switch as taken in the direction of arrows 3—3 of FIG. 2.
Figure 2:
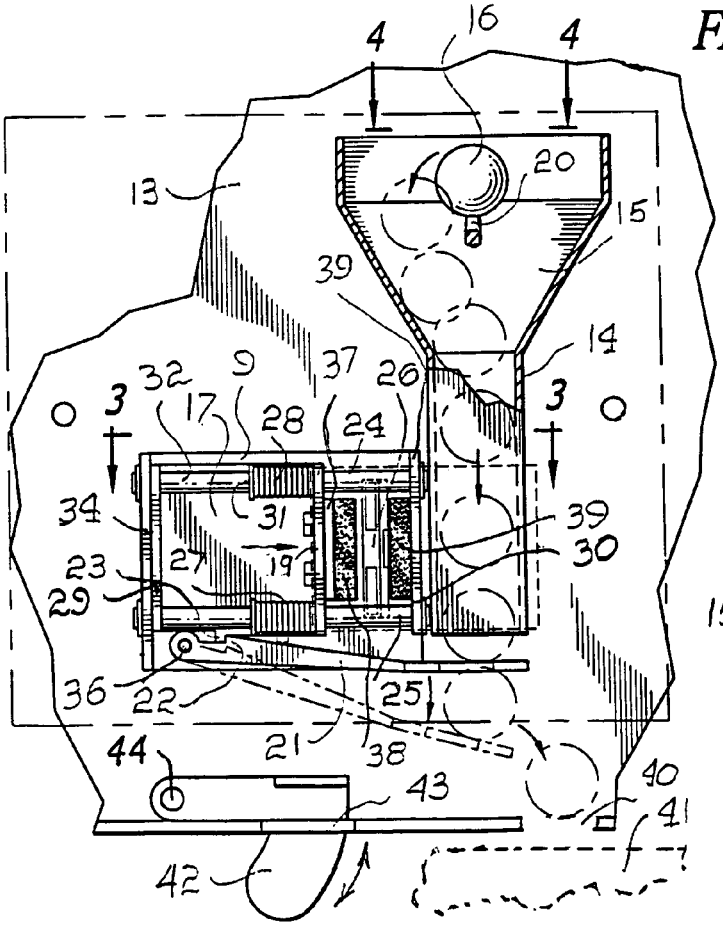
FIG. 2 is an enlarged, front elevational view of the automatic shut-off switch employed on the circuit breaker box shown in FIG. 1.

Referring now in detail to FIGS. 2 and 3, it can be seen that the chute 14 supports the tapered funnel 15 through which the actuator ball 16 travels when unseated from a perch or seat 20. The lower end of the chute 14 is open for deployment of the actuator ball that engages a pivoting lever 21 which is illustrated in solid lines in its preparatory position for release of the carriage 17. The lever 21 includes a latch mechanism having a catch 22 which engages or disengages with a hook 23 to either restrain or release the carriage.

The carriage 17 includes flanges 19 and 29 slidably mounted on rods 24 and 25 that are fixed between flanges 30 and 34 mounted on base plate 9. The rods are arranged in fixed, parallel, spaced-apart relationship so as to expose a conventional master circuit breaker switch 26 which is carried on the circuit breaker unit immediately behind the panel 13. Resilient means, such as coil springs 27 and 28, are compressed, as shown in FIG. 2, between the carriage flange 19 and stationary stops, such as stop 31, on the end of a fixed sleeve 32. A rear flange 34 serves as a stop when the carriage is moved away from the main power switch 26 and engagement occurs between stop plate 34 and the flange 29 on base plate 9.

When the lever 21 has been activated by the activating ball 16, the lever will pivot about a pivot 36 to the position shown in broken lines which releases the catch 22 so that the hook 23 is released and the carriage is free and unrestricted, whereby the expansion of springs 27 and 28 cause the carriage 17 to move along the rods 24 and 25 towards the main power switch 26. Such movement causes the carriage plate 19 carrying a striker member 37 in FIG. 3 to impact the main power circuit breaker switch arm 26 and causes it to flip to its "off" position. A first cushion 38 is provided to protect the switch 26 from impact damage while a second cushion 39 receives the impact from carriage plate 19. The panel 13 includes an elongated opening 44 through which the striker member 37 passes so that the switch arm 26 is in its path when the carriage is released.

Figure 5:
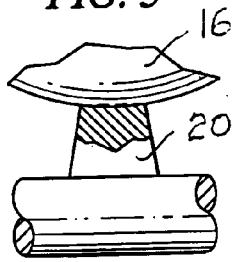
FIG. 5 is a fragmentary view illustrating the mechanical element placed on the seat as shown in FIG. 4.
Figure 4:
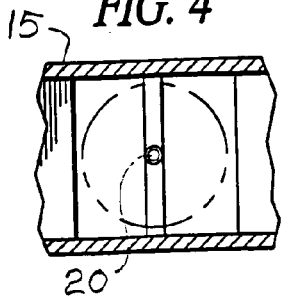
FIG. 4 is a cross sectional view of the mechanical element, such as a ball, disclosing the seat on which the mechanical element is perched.

Therefore, it can be seen that the actuating ball 16 rests on top of the perch or seat 20, as seen in FIGS. 4 and 5, in a balanced position and that any physical movement which upsets the box 11 will cause the ball to topple, as shown in broken lines in FIG. 2, so that it falls through the tapered funnel 15 into the chute 14 and exits at the bottom into engagement with lever 21. The lever will pivot on pivot 36 to release the latch mechanism so that the expansion of compressed springs 27 and 28 causes the striker member 37 on carriage 17 to strike the switch arm 26. Once the ball has been employed for actuating lever 21, the ball will exit an opening 40 for collection in a basket 41. The panel 13 can be releasably latched to the box 11 by means of latch 42 that engages a slot 43 in the bottom of box 11. The latch 42 is pivotally mounted on the front face of panel 13 by means of pivot 44. Raising of the latch frees the panel for access to the underlying circuit breakers including the master circuit breaker switch 26, so that the switch may be reset.

Figure 6:
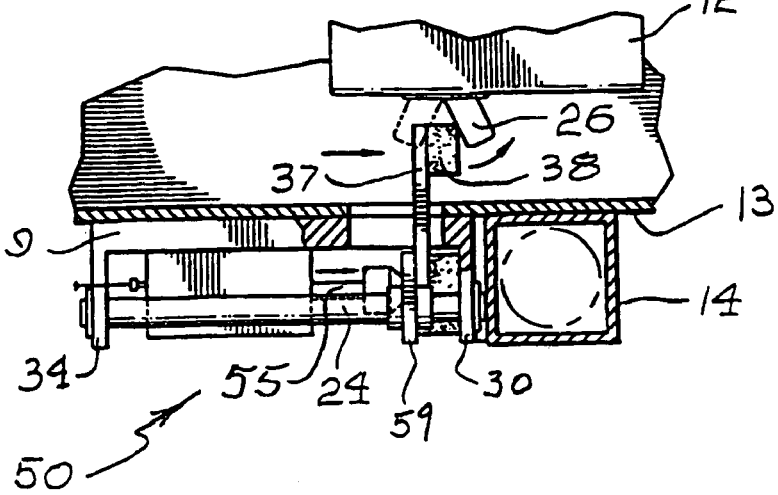
FIG. 6 is a fragmentary top plan view, similar to the view of FIG. 3, illustrating a solenoid operated means for automatically shutting off the main power to a circuit breaker arrangement.
Figure 7:
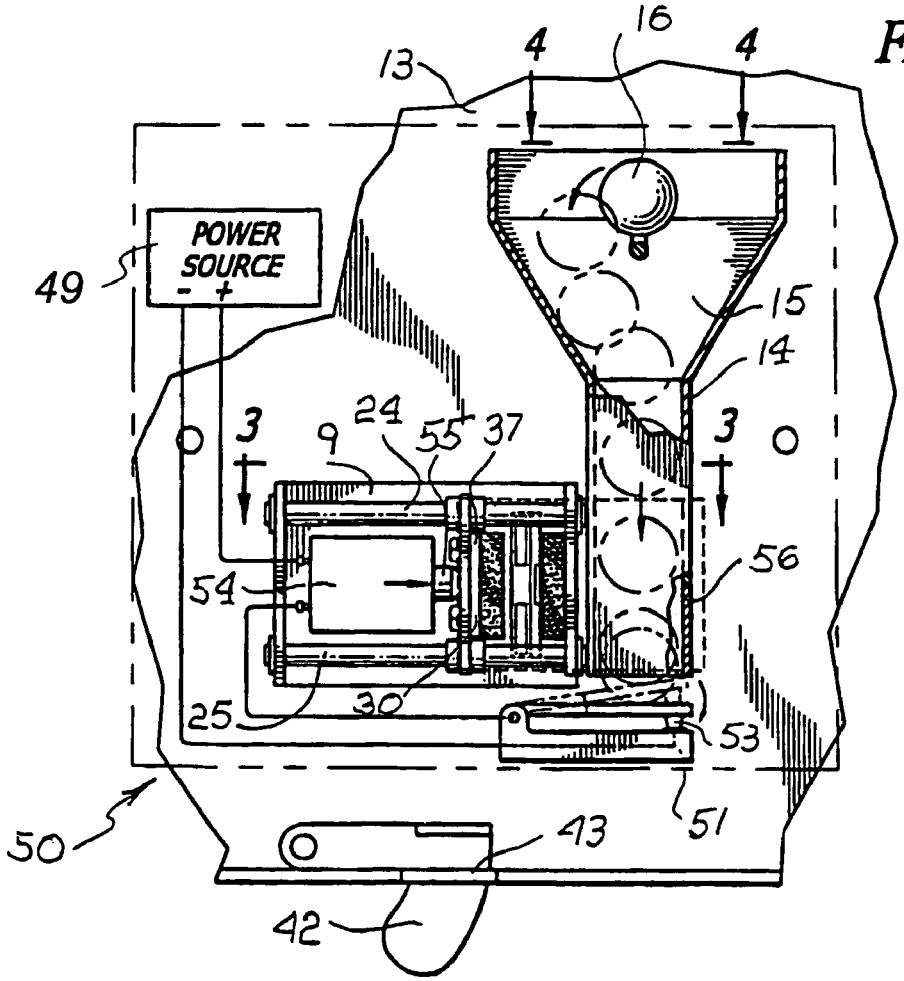
FIG. 7 is a front elevational view of the solenoid operated shut-off means illustrated in FIG. 6.

Referring now to FIGS. 6 and 7, another version of the present invention is illustrated in the general direction of arrow 50 in which the balanced ball 16 is deployed from its perch and travels through funnel 15 into chute 14 as previously described. However, the actuator ball 16 strikes a lever arm of a micro-switch 51 which closes contacts 53 to conduct power from a power source 49 into a solenoid operated device 54. The activation of the coil in the solenoid device 54 causes a slug 55 to outwardly travel against a carriage plate 59. Since the striker member or arm 37 is carried on the carriage plate 59, the end of the arm 37 will impact against switch 26, as shown in FIG. 6, and throw the switch to the "off" position. FIG. 6 shows extension of the slug 55 from the body of the solenoid 54. However, FIG. 7 illustrates the position of the slug 55 preparatory for energizing of the coil which would cause the slug to outwardly project and cause the switch 26 to move to its "off" position.

Also, it is noted that a sliding door 56 is carried on the side of the chute 14 so that the actuating ball 16 may be conveniently removed after striking the micro-switch 51 and closing contacts 53.

The carriage plate 59 slides on the rods 24 and 25 as previously described and the micro-switch 51, solenoid device 54 and power supply 53 are all coupled together in an operable electric circuit. The open position of the contacts 53 are shown in broken lines and the closed contacts are shown in solid lines in FIG. 7.

In view of the foregoing, it can be seen that whether a mechanical or electrical system is used, upon actuation by the displacement of actuating ball 16, the carriage or carriage plate is released either mechanically or electrically, so that the arm 37 will impact against the switch arm 26 and forces the arm 26 into the "off" position. The entire system may be readily reset by replacing the ball on its perch and by reversing the carriage or carriage plate to its rearmost position. The switch arm 26 can then be placed into the "on" position and the system is ready for activation by the actuating ball 16.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An automatic shut-off switch for main power source comprising:

a circuit breaker network having a main power shut-off switch connected to a main source of power thereto;

a movable carriage mounted adjacent to said shut-off switch for selectively operating said shut-off switch to terminate said main source of power;

resilient means engageable with said movable carriage to restrain said movable carriage from said shut-off switch; and actuation means carried in close proximity to said movable carriage operable to release said resilient means to advance said movable carriage for forcible engagement with said shut-off switch to shut off power from said main switch of power.

2. The automatic shut-off switch defined in claim 1 wherein:

said resilient means includes a compression spring normally biasing said movable carriage away from said shut-off switch; and said actuator means releasably coupled with said resilient means for releasing said spring for expansion to move said movable carriage to actuate said shut-off switch to an off condition.

3. The automatic shut-off switch defined in claim 2 wherein:

said actuator means includes a mechanical element upset by vibratory movement to release said compression spring.

4. The automatic shut-off switch defined in claim 3 wherein:

said actuator means includes a catch and latch mechanism operable in response to engagement by said mechanical element to release said movable carriage permitting expansion of said compression spring.

5. The automatic shut-off switch defined in claim 4 wherein:

said actuator means further includes a pivot lever having a catch engageable with a latch on said movable carriage; and said latch disengageable from said catch upon engagement of said mechanical element with said lever.

6. The automatic shut-off switch defined in claim 5 including:

a perch for releasably supporting said mechanical element in alignment with said lever.

7. The automatic shut-off switch defined in claim 6 including:

a tapered chute enclosing said perch and terminating immediately above said lever.

8. The automatic shut-off switch defined in claim 7 including:

an arm outwardly projecting from said carriage in alignment with said shut-off switch operable to engage said shut-off switch at the release of said carriage to terminate said main source of power to said circuit breaker network.

9. An automatic shut-off switch for main power source comprising:

a plurality of circuit breakers connected to a main source of power;

a shut-off switch connecting said main source of power with said plurality of circuit breakers and normally positioned to a closed condition;

a base mount having an opening in alignment with said shut-off switch;

a carriage slidably mounted on said base mount and having an arm projecting through said opening in alignment with said shut-off switch;

resilient means normally compressed between said base mount and said carriage maintaining said arm out of engagement with said shut-off switch; and actuator means responsive to a shaking movement to release said carriage whereby expansion of said resilient means urges said arm into forcible engagement with said shut-off switch disconnecting said main power source from said plurality of circuit breakers.

10. The automatic shut-off switch defined in claim 9 wherein:

said actuator means includes a gravity deployable element mounted on said base mount and a pivotal lever responsive to deployment of said element to release said compression resilient means.

11. The automatic shut-off switch defined in claim 10 including:

a latch and catch mechanism releasably coupling said lever with said carriage whereby unlatching of said latch and catch mechanism releases said carriage for advancement in response to expansion of said compressed resilient means to engage said arm with said shut-off switch.

12. The automatic shut-off switch defined in claim 11 wherein:

said element is a ball balanced on a perch secured to said mount.

13. The automatic shut-off switch defined in claim 12 wherein:

said resilient means is a coil spring having a first position compressed between said base mount and said carriage and a second position expanded to advance said carriage and said arm in response to release of said carriage by said latch and catch mechanism.

14. The automatic shut-off switch defined in claim 13 including:

a tapered chute secured to said base mount for conducting said ball to said lever when deployed by gravitational force from said perch.

* * * * *